US006457585B1

(12) United States Patent
Huffer et al.

(10) Patent No.: US 6,457,585 B1
(45) Date of Patent: Oct. 1, 2002

(54) PACKAGING WITH INCORPORATED TEMPORARY TATTOO

(75) Inventors: Scott W. Huffer, Hartsville; Jeffrey M. Schuetz, Florence, both of SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/702,365

(22) Filed: Oct. 31, 2000

(51) Int. Cl.[7] ..... B65D 85/00
(52) U.S. Cl. ..... 206/459.5; 283/81; 283/97
(58) Field of Search ..... 206/459.5, 831; 40/306, 310, 312; 283/81, 97, 101

(56) References Cited

U.S. PATENT DOCUMENTS

| | | | | |
|---|---|---|---|---|
| 1,756,944 | A | 5/1930 | Gorton, Jr. | |
| 1,982,282 | A | 11/1934 | Bock | 273/139 |
| 2,093,985 | A | 9/1937 | Stansbury | 40/2 |
| 2,254,545 | A | 9/1941 | Roberts | 40/2 |
| 3,524,782 | A | 8/1970 | Buske | 156/248 |
| 3,638,340 | A | 2/1972 | Gottschalk | 40/2 |
| 3,835,564 | A | 9/1974 | Gottschalk | 40/2 |
| 4,169,169 | A | 9/1979 | Kitabatake | 427/149 |
| 4,308,679 | A | 1/1982 | Ray, III et al. | 40/312 |
| 4,336,664 | A | 6/1982 | Penick et al. | 40/594 |
| 4,551,373 | A | 11/1985 | Conlon | 428/43 |
| 4,594,276 | A | 6/1986 | Relyea | 428/40 |
| 4,648,548 | A | 3/1987 | Shin | 229/8 |
| 4,846,504 | A | 7/1989 | MacGregor et al. | 283/102 |
| 5,127,743 | A | 7/1992 | Miller et al. | 383/109 |
| 5,601,859 | A | 2/1997 | Penaluna | 426/5 |
| 5,676,401 | A | 10/1997 | Witkowski et al. | 283/81 |
| 5,776,586 | A | 7/1998 | Lipper | 428/195 |
| 5,816,269 | A | 10/1998 | Mohammed | 132/319 |
| 5,817,385 | A | 10/1998 | Stanislav | 428/40.2 |
| 5,871,096 | A | 2/1999 | Yakich | 206/459.5 |
| 5,928,797 | A | 7/1999 | Vineberg | 428/500 |
| 5,942,065 | A | 8/1999 | Biggs et al. | 156/90 |
| 5,958,560 | A | 9/1999 | Evan | 428/201 |
| 6,013,122 | A | 1/2000 | Klitzman et al. | 106/31.03 |
| 6,074,721 | A * | 6/2000 | Moore et al. | 283/81 |

* cited by examiner

*Primary Examiner*—David T. Fidei
(74) *Attorney, Agent, or Firm*—Drinker Biddle & Reath LLP

(57) ABSTRACT

A temporary tattoo is releaseably incorporated into a multi-ply re-sealable package capable of holding comestibles. The temporary tattoo is incorporated into the package between the plies and contains a tattoo ink printed either flexo or gravure and, once removed from the resealable package, is moistened and applied to the skin.

15 Claims, 2 Drawing Sheets

PACKAGING WITH INCORPORATED TEMPORARY TATTOO

FIELD OF THE INVENTION

The present invention relates generally to a package which has incorporated into its defining walls a removable label having a temporary tattoo thereon.

BACKGROUND OF THE INVENTION

Temporary tattoos made from dyes or inks approved for use in food or cosmetics have become popular as a novelty for children. In most instances, the tattoos are printed on a paper substrate with water soluble inks. If the paper is placed in contact with the skin in the presence of moisture, the inks bleed off from the substrate onto the skin, forming a removable tattoo.

In the past, various attempts have been made to provide a temporary tattoos as a promotional item by placing a temporary tattoo inside a package. It is common practice to separately package a temporary tattoo and to place it with a larger package which contains any of various food products. A separate package is desired to prevent the tattoo ink from contacting and staining the food products contained in the package.

There have also been attempts to simply place the temporary tattoo, on its substrate but without separate packaging, into the larger package in the hope that the larger package will provide a 100% moisture barrier. However, moisture often infiltrates such packages by force of nature or otherwise, causing the tattoo inks to bleed or otherwise become damaged. often infiltrates such packages by force of nature or otherwise, causing the tattoo inks to bleed or otherwise become damaged.

SUMMARY OF THE INVENTION

The present invention is directed to a package having a temporary tattoo which is easily removable from the exterior of the package. The walls of the package comprise at least two plies, an outer ply having an exterior and an interior surface and a second ply including a first surface facing the interior surface of the outer ply and a second, interior facing surface. The interior surface of the outer ply and the first surface of the second ply are preferably permanently adhered to one another over a major portion of the package. At the location of the temporary tattoo, the outer ply and the second ply are either not adhered or are releasably adhered to one another. An adhesive blocker may be applied to the adhesive. The temporary tattoo is not in contact with any adhesive in either embodiment. The non-adhered or releasably-adhered portion of the package which holds the temporary tattoo within the walls of the package may be defined by a series of perforations within the outer ply to facilitate removal of the tattoo from the package, provided that measures are taken to prevent moisture in sufficient quantity from reaching the tattoo through the perforations to spoil the tattoo, or the tattoo can be cut with scissors and removed from the package.

The outer ply may be made out of oriented polypropylene, polyethylene terephthalate, or another clear polymer. The second ply is preferably a white polyethylene film. A clear outer ply makes it possible to view, from outside the package, the temporary tattoo located at the non-adhered or releasably adhered portion, along with other, visible messages located on the interior surface of the outer ply or the outer surface of the second ply elsewhere on the package.

Such other messages may advertise or describe the product contained within. The tattoo ink may be printed on the clear outer ply by any suitable known method.

BRIEF DESCRIPTION OF THE DRAWINGS

For the purpose of illustrating the invention, there is shown in the drawings a form which is presently preferred; it being understood, however, that FIG. 1 is a perspective view of a package of the present invention, showing the front wall, incorporating a temporary tattoo, and one side.

DETAILED DESCRIPTION OF THE DRAWINGS

Figure 1:
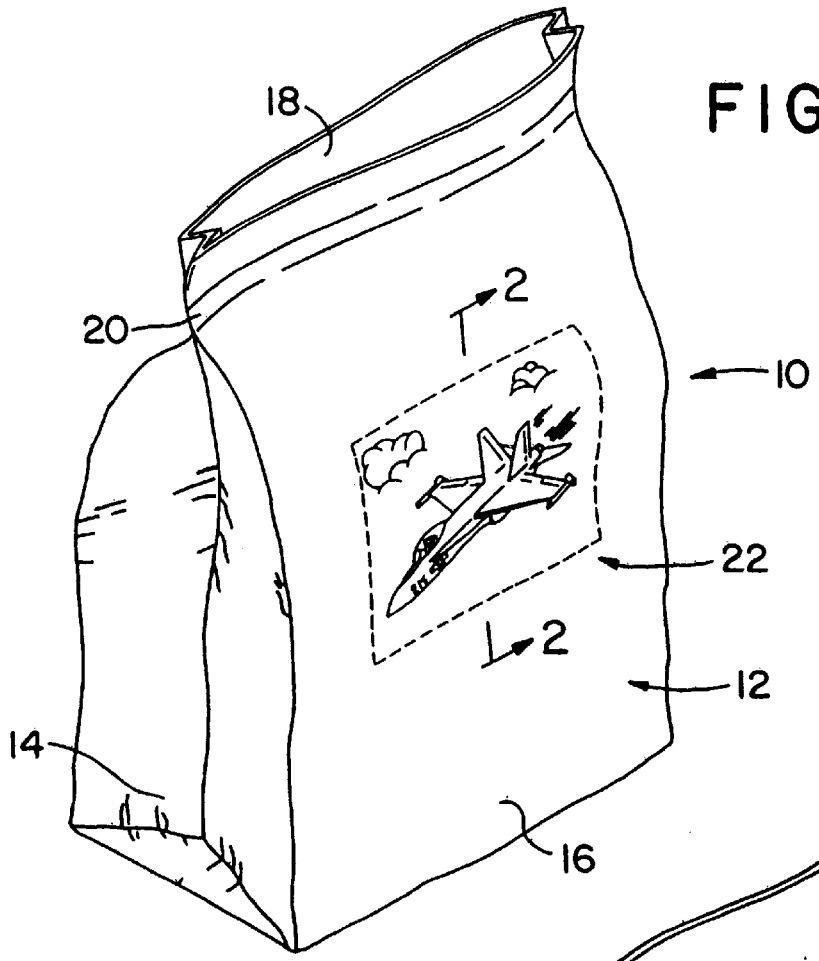

With reference to the drawings where like numerals identify like elements, there is shown in FIG. 1 a package or bag which is generally identified by the numeral 10. The package 10 is formed from a laminate material indicated generally by the reference numeral 12. As shown in FIG. 1, the package is formed with a flat bottom (not shown), gusseted sides 14, and a generally flat front wall 16 and rear wall 18, and is closed by a weld 20 near the top fastening together the front, rear, and side walls. However, it will be understood by those skilled in the art that the present invention may be applied to other sorts of package. A temporary tattoo indicated generally by the reference numeral 22, which will be described in greater detail hereinbelow, is place on the front wall 16. It will be understood by the person skilled in the art, however, that the specific shape and construction of the package 10 are not essential to the present invention, and that other shapes and constructions are used. It is desired only that there be at least one wall portion of the package 10, corresponding to the front wall 16 in the illustrated embodiment, that presents a smooth, flattish area sufficiently large to contain and display the temporary tattoo 22.

Figure 2:
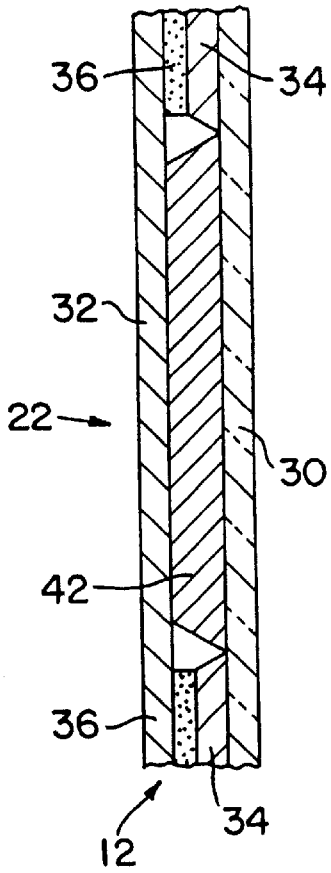
FIG. 2 is a cross-sectional view taken along the line 2—2 of FIG. 1, showing the structure of the package walls.

Referring now to FIG. 2, the laminate material 12 forming the walls of the package 10 is of a conventional two-ply or layer construction, including an outer ply 30, a second or inner ply 32, ink printing 34 on the inner surface of the outer ply 30, and an adhesive 36 permanently adhering the plies 30 and 32 together. The outerply 30 is maybe of oriented polypropylene, polyethylene terephthalate, or other suitable material. The outer ply 30 is preferably clear and transparent, so that the printing on the inside of it is clearly visible from the outside of the package 10. The main requirements for the material of the outer ply 30 are that it be resistant to abrasion and that it provide a good substrate for ink printing. It must also be sufficiently water-impermeable to protect the tattoo 22 from normal exposure of the package 10 to water.

The innerply 32 of the laminate material 12 may be of polyethylene, polypropylene, polyethylene terephthalate, coated paper, or other suitable material to provide a vapor barrier against the escape of volatiles from the contents of the package or the penetration of oxygen or environmental volatiles that might contaminate the contents. If the package 10 is being sealed closed by a weld 20 as shown in FIG. 1, then the inner ply 32 should be of weldable material, or should have a weldable coating. Other forms of closure may be used, and it will be appreciated that if the package is not to be welded a wider choice of materials is available for the inner ply of the laminate.

If the contents of the package contain available water, then the inner ply 32 also needs to be waterproof in order to protect the tattoo 22. The inner ply 32 of the material 12 is preferably opaque and white in color, so as to provide a clear background for the printing. Any suitable ink 34 and adhesive 36 may be used. It will be understood by those skilled in the art that the choice of adhesive 36 and ink 34 will depend on the contents of the package and the material of the inner ply 32. In particular, if the package contains food, it is essential for both practical and regulatory reasons to ensure that the ink or adhesive do not contain undesirable components, such as solvents, that are capable of penetrating the inner ply 32.

Figure 3:
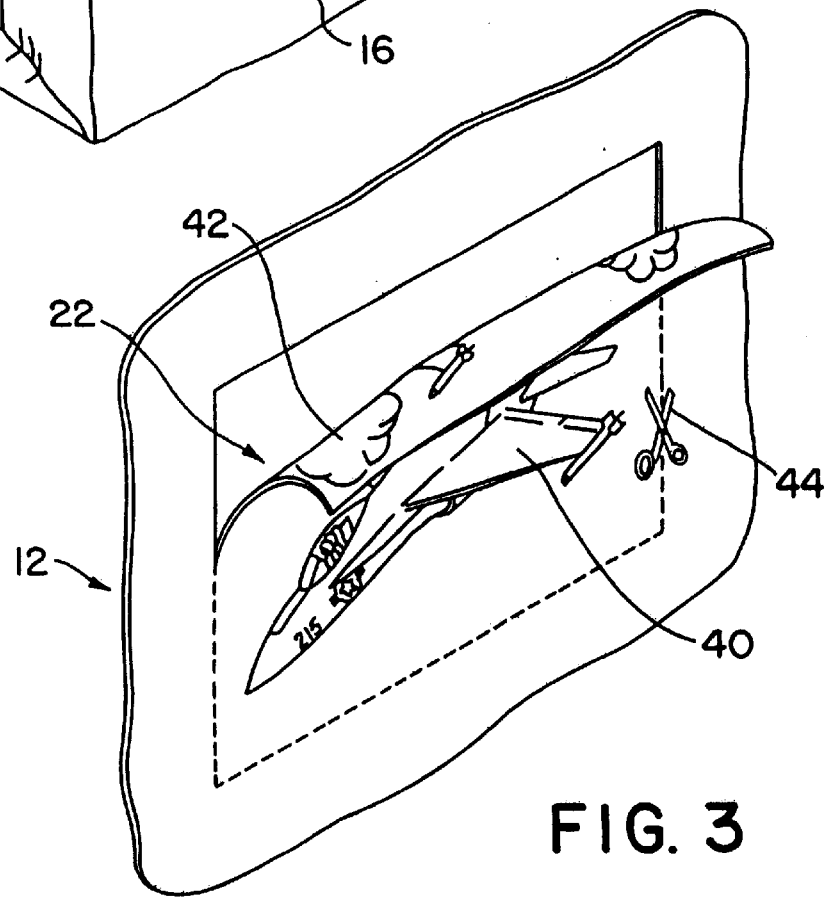
FIG. 3 is a fragmentary view of a portion of the package and particularly illustrating the removal of a temporary tattoo which is incorporated in the wall of the package.

Referring now to FIGS. 2 and 3, the temporary tattoo 22 is constituted by a portion of the material 12 from which the ink 34 and adhesive 36 are absent. Instead, a tattoo image 40 is reverse-printed on the inside of the outer ply 30 in water-soluble ink 42. Because the tattoo 22 will be applied to the skin, it is essential that a harmless ink be used. Suitable inks 42 that are approved for use in cosmetics or as food coloring are commercially available. One suitable series of inks are the "Non-Tox" NTO8 inks sold by Colorcon. The tattoo ink may be flexographically printed, gravure printed, or applied by any other suitable method. As shown in FIG. 1, the tattoo image 40 is visible from the outside of the package 10 through the transparent outer ply 30 of the laminate material 12. Instead, the tattoo may be concealed, for example behind an opaque or printed outer ply. There is no adhesive 36 between the tattoo image 42 and the inner ply 32 of the material 12, so that the inner and outer plies 30 and 32 are free from one another in that region, and are held together only in that they both continue into the permanently adhered regions of the material 12 at the edges of the tattoo region. Thus, the plies 30 and 32 can easily be separated to expose the tattoo after separation from the surrounding material.

In order to apply the tattoo 22 to a person's body, the tattoo 22 is first cut out of the material 12 of the package 10, for example, with scissors 44. The entire thickness of the material 12 maybe cut through, and the inner and outer plies 30 and 32 then separated. Instead, one blade of the scissors 44 may be introduced between the plies 30 and 32 at the region where there is no adhesive, and only the outer ply 32 may be cut out.

Figure 4:
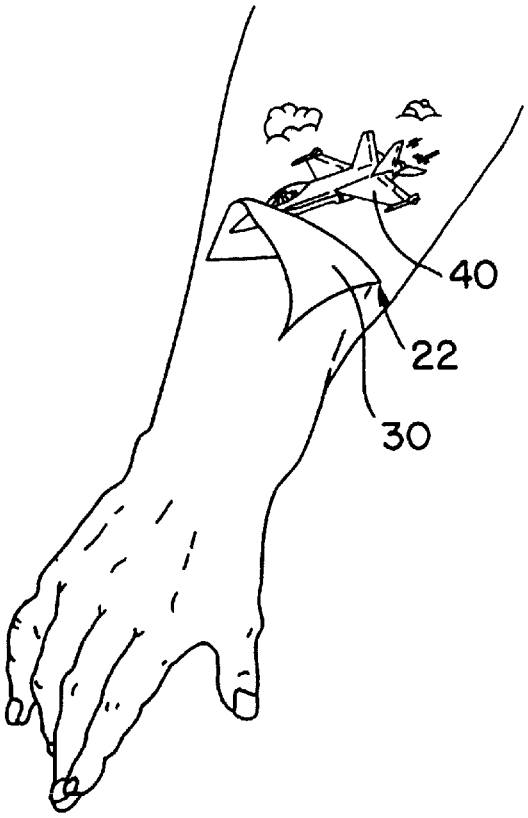
FIG. 4 shows a temporary tattoo being applied to a human arm.

As shown in FIG. 4, the cut out portion of the outer ply 30, with the tattoo image 40 on its reverse side, is then placed against a user's skin. The skin is preferably damped first, in order to ensure that there is sufficient moisture to mobilize the ink 42. The ink 42 then bleeds from the material ply 30 onto the user's skin, where it forms a temporary tattoo image on the skin. Because the tattoo image 40 is formed with water soluble ink applied to the surface of the skin, it will remain visible for only a limited period of time.

Figure 5:
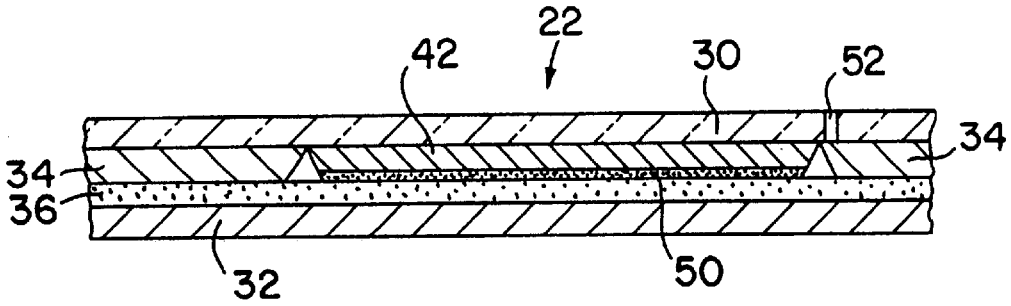
FIG. 5 is a cross-sectional view of another embodiment of the structure of the package walls.

Referring now to FIG. 5, in an alternative embodiment of the invention the adhesive 36 is continuous over the area of the tattoo 22. An adhesive blocker 50 is applied between the water-soluble ink 42 and the adhesive 36. The blocker 50 is selected so that it will separate completely from the ink 42, leaving the ink exposed for application of the tattoo 40 to a user as shown in FIG. 4. This embodiment is advantageous if the laminating process is such that it is impractical to leave a gap in the adhesive layer at the location of the tattoo 22. The adhesive blocker 50 may be selected to allow weak adhesion between the inner and outer plies 30 and 32, to avoid the possibility of scuffing of the tattoo image 40 during handling of the package 10, provided that the adhesion is sufficiently weak that the tattoo image will not be damaged when the plies are separated.

In the interests of clarity and simplicity, the ink 34 and 42 has been shown in FIGS. 2 and 5 as solid blocks. It will be understood by the person skilled in the art, however, that the ink will in practice usually be printed in the form of text or graphics, as shown for the tattoo in FIGS. 1, 3, and 4, typically involving more than one color of ink, spaces with no ink, and areas with varying thicknesses of ink.

In order to facilitate removal of the tattoo 22 from the package 10 without the use of scissors 44, in either embodiment a line of weakness in the form of perforations 52 (see FIG. 5) or scoring (not shown) may be provided in the outer ply 30 of the material 12. In order to prevent water penetrating through the perforation 52 to the tattoo ink 42, the perforations are preferably placed where they will be sealed by the printing ink 34 and/or the adhesive 36.

Although in the interests of simplicity the invention has been described as applied to a simple two-ply laminate package, preferably of PET or OPP and PE, the person skilled in the art will understand how it may be applied to a laminate with other and/or additional plies of material.

The present invention may be embodied in other specific forms without departing from the spirit or essential attributes thereof and, accordingly, reference should be made to the appended claims, rather than to the foregoing specification, as indicating the scope of the invention.

What is claimed is:

1. A package having an exterior and an interior defined by at least one wall of multi-ply material, said wall comprising:

an outer ply having an exterior surface and an interior surface;

a second ply including a first surface facing the interior surface of said outer ply, and a second, interior facing surface;

the interior surface of said outer ply and the first surface of said second ply being permanently adhered to one another over a major portion of their extent;

a portion of said outer ply separable from said second ply; and a temporary tattoo ink reverse printed on the interior surface of said outer ply of said separable portion.

2. The package of claim 1, further comprising:

an adhesive layer within said separable portion of said multi-ply material, said adhesive layer contacting the first surface of said second ply; and an adhesive blocker within said separable portion between said adhesive layer and said tattoo ink.

3. The package of claim 1, wherein said tattoo ink is directly adjacent to said second ply, and said second ply is free from said outer ply at said separable portion.

4. The package of claim 1, wherein the outer ply has a perforation around said non-adhering portion.

5. The package of claim 1, wherein said outer ply is oriented polypropylene.

6. The package of claim 1, wherein said outer ply is polyethylene terephthalate.

7. The package of claim 1, wherein said second ply is a polyethylene film.

8. The package of claim 1, wherein said tattoo ink is flexographically printed onto the interior surface of the releasable portion of the outer ply.

9. The package of claim 1, wherein said tattoo ink is gravure printed onto the interior surface of the releasable portion of the outer ply.

10. The package of claim 1, wherein said temporary tattoo ink is a water soluble ink.

11. The package of claim 1, wherein the interior surface of the package is the second, interior facing surface of said second ply.

12. The package of claim 1, which is sealable by placing portions of the interior surface of the package in contact with one another and welding them together.

13. The package of claim 1, containing a vendible product and secured closed.

14. A package having an exterior and an interior defined by at least one wall of multi-ply material, said wall comprising:

an outer ply comprised of oriented polypropylene having an exterior surface and an interior surface;

a second ply comprising polyethylene film including a first surface facing the interior surface of said outer ply, and a second interior facing surface; the interior surface of said outer ply and the first surface of said second ply being permanently adhered to one another over a major portion of the package;

a portion of said outer ply not permanently adhered to said second ply; said portion comprising a temporary tattoo; and said temporary tattoo comprising a tattoo ink reversed printed on the interior surface of said outer ply of said not-permanently-adhered portion.

15. A sealable package having an exterior and an interior defined by at least one wall of multi-ply material, said wall comprising:

an outer ply comprised of polyethylene terephthalate having an exterior surface and an interior surface;

a second ply comprising polyethylene film including a first surface facing the interior surface of said outer ply and a second interior facing surface;

the interior surface of said outer ply and the first surface of said second ply being permanently adhered to one another;

a portion of said outer ply not permanently adhered to said second ply;

said portion comprising a temporary tattoo, an adhesive blocker and a second adhesive in between said outer ply and said second ply; and said temporary tattoo comprising a tattoo ink reversed printed on the interior surface of said outer ply of said non-adhering portion.

* * * * *